US005375261A

United States Patent [19]

Lipke

[11] Patent Number: 5,375,261

[45] Date of Patent: Dec. 27, 1994

[54] DICKIES OF A CYLINDRICAL KNIT WITH A POCKET FOR A WARMER PACK

[76] Inventor: Daniel R. Lipke, 228 Plummer Ave., Neenah, Wis. 54956

[21] Appl. No.: 172,062

[22] Filed: Dec. 23, 1993

[51] Int. Cl.[5] ..... A41D 1/04

[52] U.S. Cl. ..... 2/92; 2/90; 2/103

[58] Field of Search ..... 2/92, 103, 90, 169 R; 66/170, 171

[56] References Cited

U.S. PATENT DOCUMENTS

D. 181,831 1/1958 Bacon ..... 2/92

3,531,952 10/1970 Chesebro, Jr. ..... 66/171

*Primary Examiner*—Clifford D. Crowder

*Assistant Examiner*—Gloria Hale

*Attorney, Agent, or Firm*—Michael J. Colitz, Jr.

[57] ABSTRACT

A dickie of a generally cylindrical configuration comprising an upper extent formed with a neck opening of a cylindrical configuration for passage of a wearer's head and having a reduced diameter, the neck opening having a turned over upper end and a pair of knitted layers with downwardly extending lower ends. An intermediate extent is formed in the shape of a cone having a reduced upper diameter formed as integral extensions of the lower portion of the upper extent and having an enlarged lower diameter with an increasing diameter from the upper diameter to the lower diameter, the intermediate extent being formed as a pair of knitted layers. A lower extent is formed as a body opening and has a cylindrical configuration with an enlarged diameter, the body opening including a pair of knitted layers with downwardly extending lower ends and with upper ends formed as integral extensions of the lower ends of the intermediate extent.

4 Claims, 3 Drawing Sheets

DICKIES OF A CYLINDRICAL KNIT WITH A POCKET FOR A WARMER PACK

BACKGROUND OF THE INVENTION

1. Field of the Invention

The present invention relates to dickies of a cylindrical knit with a pocket for a warmer pack and more particularly pertains to warming the wearer of a dickie with a warmer pack removably positioned within the pocket of a dickie.

2. Description of the Prior Art

The use of dickies and other forms of apparel is known in the prior art. More specifically, dickies and other forms of apparel heretofore devised and utilized for the purpose of warming the wearer of dickies and other apparel are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,168,543 to Baker a protective neck garment.

U.S. Pat. No. 4,457,295 to Roehr discloses a warming garment for heating people.

U.S. Pat. No. 4,780,912 to Harmsen discloses a dickey.

U.S. Pat. No. 5,005,374 to Spitler discloses thermal wraps.

U.S. Pat. No. 5,072,598 to Dibrell discloses a scarf for transferring heat from or to body areas of the wearer.

Lastly, U.S. Pat. No. 5,088,549 to Schneider discloses a tying neckband heat transfer device.

In this respect, dickies of a cylindrical knit with a pocket for a warmer pack according to the present invention substantially depart from the conventional concepts and designs of the prior art, and in doing so provide an apparatus primarily developed for the purpose of warming the wearer of a dickie with a warmer pack removably positioned within the pocket of a dickie.

Therefore, it can be appreciated that there exists a continuing need for new and improved dickies of a cylindrical knit with a pocket for a warmer pack which can be used for warming the wearer of a dickie with a warmer pack removably positioned within the pocket of a dickie. In this regard, the present invention substantially fulfills this need.

SUMMARY OF THE INVENTION

In view of the foregoing disadvantages inherent in the known types of dickies and other forms of apparel now present in the prior art, the present invention provides improved dickies of a cylindrical knit with a pocket for a warmer pack. As such, the general purpose of the present invention, which will be described subsequently in greater detail, is to provide new and improved dickies of a cylindrical knit with a pocket for a warmer pack and methods which have all the advantages of the prior art and none of the disadvantages.

To attain this, the present invention essentially comprises a new and improved dickie of a cylindrical knit with a pocket for a warmer pack comprising, in combination, an upper extent formed with a neck opening of a cylindrical configuration for passage of a wearer's head and having a reduced diameter, the neck opening having a turned over upper end and a pair of knitted layers with downwardly extending lower ends. An intermediate extent is formed in the shape of a cone having a reduced upper diameter formed as integral extensions of the lower portion of the upper extent and having an enlarged lower diameter with an increasing diameter from the upper diameter to the lower diameter, the intermediate extent being formed as a pair of knitted layers. A lower extent is formed as a body opening and having a cylindrical configuration with an enlarged diameter, the body opening including a pair of knitted layers with downwardly extending lower ends and with upper ends formed as integral extensions of the lower ends of the intermediate extent: A pair of diametrically opposed vertical slits are provided for passage of a wearer's shoulders extending upwardly from the lower ends of the lower extent to adjacent the lower ends of the intermediate extent. A pocket is formed at a horizontal cut in the upper extent for the removable receipt of a warmer pack, the pocket located circumferentially centered midway between the vertical slits.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved dickies of a cylindrical knit with a pocket for a warmer pack which have all the advantages of the prior art dickies and other forms of apparel and none of the disadvantages.

It is another object of the present invention to provide new and improved dickies of a cylindrical knit with a pocket for a warmer pack which may be easily and efficiently manufactured and marketed.

It is a further object of the present invention to provide new and improved dickies of a cylindrical knit with a pocket for a warmer pack which are of a durable and reliable construction.

An even further object of the present invention is to provide new and improved dickies of a cylindrical knit with a pocket for a warmer pack which are susceptible of a low cost of manufacture with regard to both materials and labor, and which accordingly are then susceptible of low prices of sale to the consuming public, thereby making such dickies of a cylindrical knit with a pocket for a warmer pack economically available to the buying public.

Still yet another object of the present invention is to provide new and improved dickies of a cylindrical knit with a pocket for a warmer pack which provide in the apparatuses and methods of the prior art some of the advantages thereof, while simultaneously overcoming some of the disadvantages normally associated therewith.

Even still another object of the present invention is to warm the wearer of a dickie with a warmer pack removably positioned within the pocket of a dickie.

Lastly, it is an object of the present invention to provide a new and improved dickie of a generally cylindrical configuration comprising an upper extent formed with a neck opening of a cylindrical configuration for passage of a wearer's head and having a reduced diameter, the neck opening having a turned over upper end and a pair of knitted layers with downwardly extending lower ends. An intermediate extent is formed in the shape of a cone having a reduced upper diameter formed as integral extensions of the lower portion of the upper extent and having an enlarged lower diameter with an increasing diameter from the upper diameter to the lower diameter, the intermediate extent being formed as a pair of knitted layers. A lower extent is formed as a body opening and has a cylindrical configuration with an enlarged diameter, the body opening including a pair of knitted layers with downwardly extending lower ends and with upper ends formed as integral extensions of the lower ends of the intermediate extent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
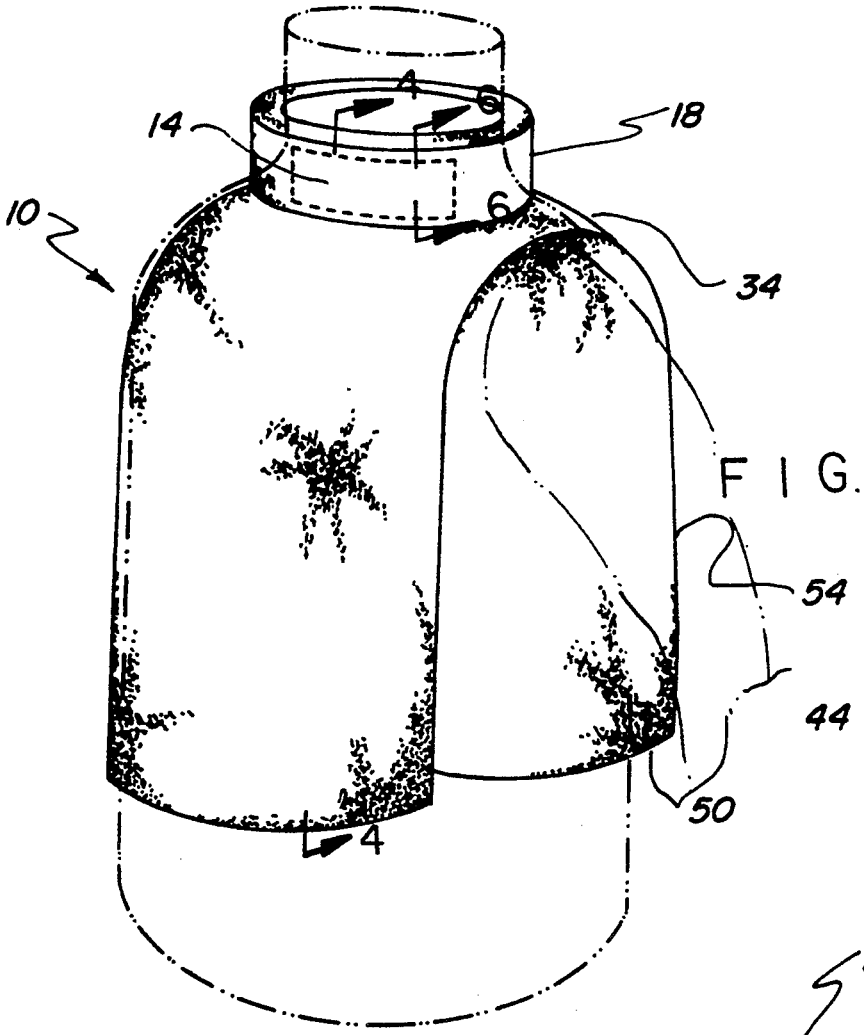
FIG. 1 is a perspective illustration of the preferred embodiment of the dickies of a cylindrical knit with a pocket for a warmer pack constructed in accordance with the principles of the present invention.
Figure 2:
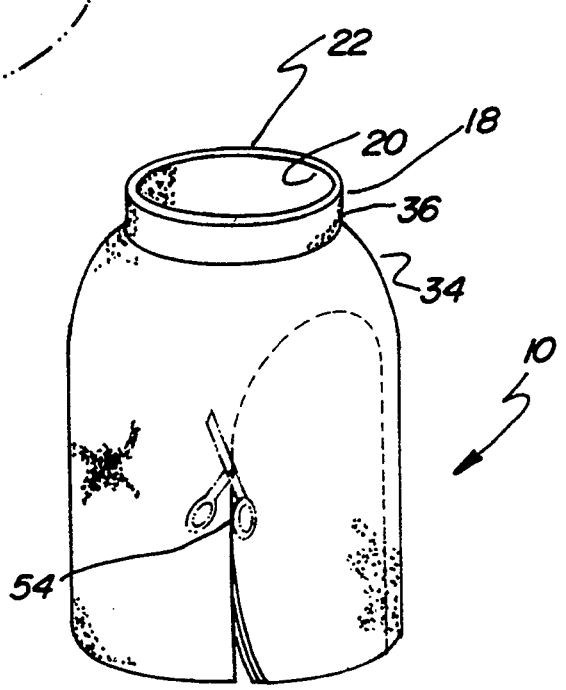
FIG. 2 is a perspective view of the device of FIG. 1 but illustrating it prior to being positioned on a wearer.
Figure 3:
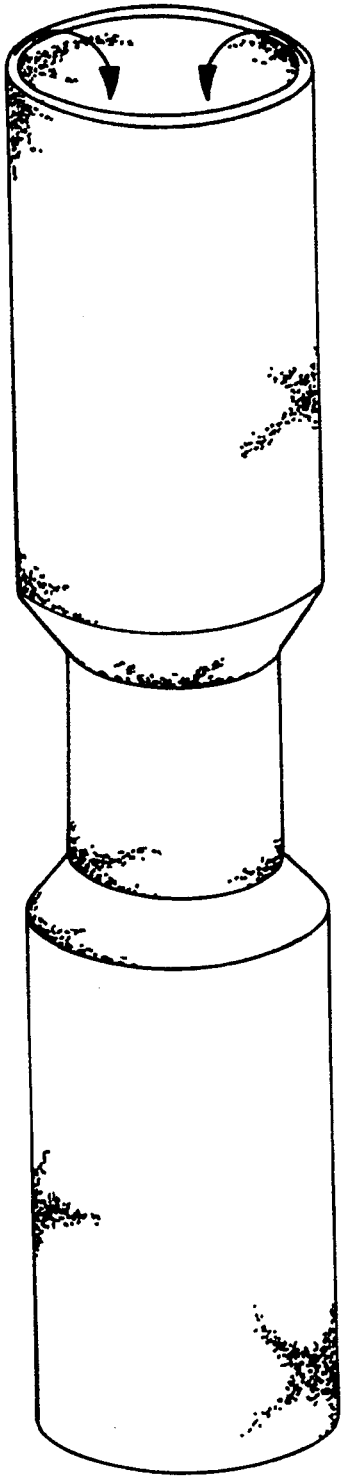
FIG. 3 is a perspective illustration of the tubular knit of which the present invention is made prior to being configured for use as the dickie.
Figure 4:
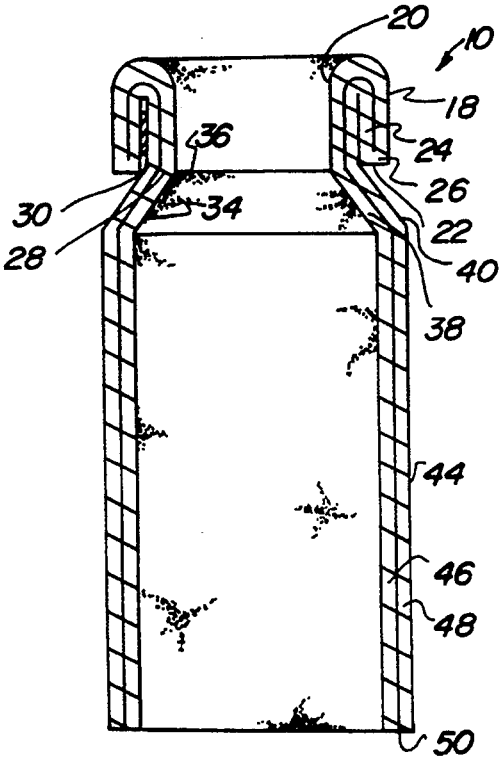
FIG. 4 is a sectional view of the device taken along the vertical center line thereof.
Figure 5:
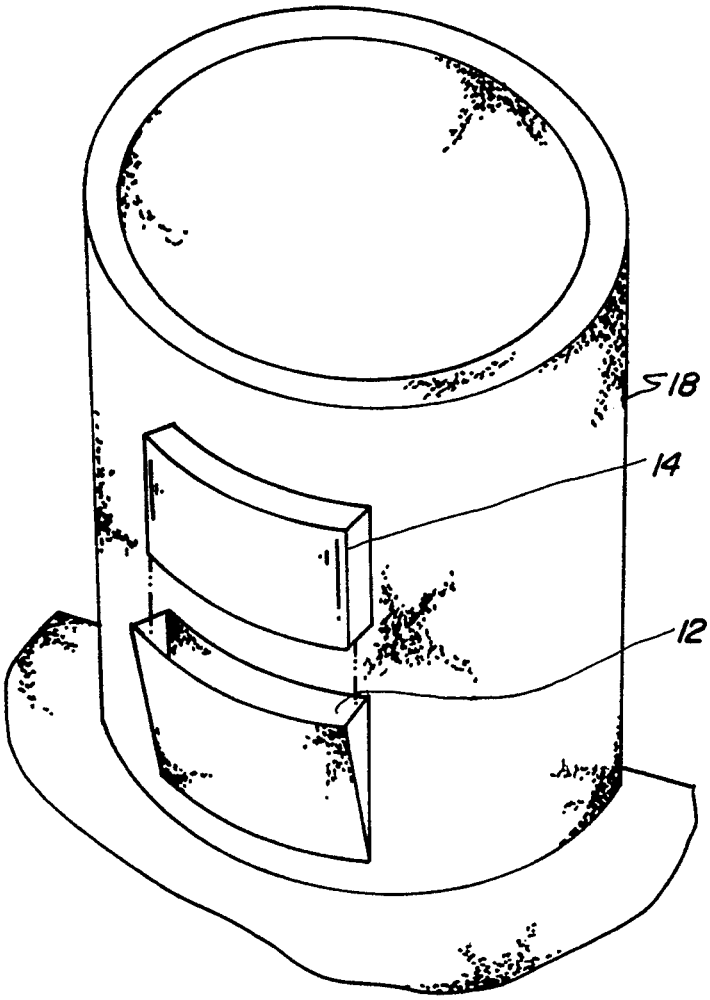
FIG. 5 is an enlarged perspective view of the upper extent or neck portion of the dickie of the prior Figure.
Figure 6:
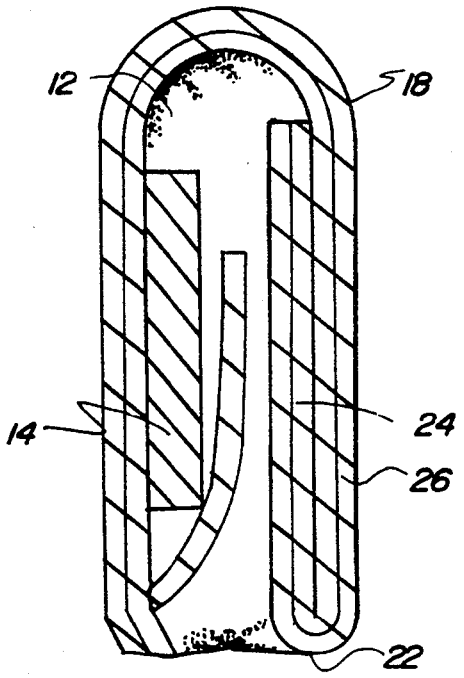
FIG. 6 is an enlarged cross-sectional view taken along line 6—6 of FIG. 1.

With reference now to the drawings, and in particular to FIG. 1 thereof, the preferred embodiment of the new and improved dickies of a cylindrical knit with a pocket for a warmer pack embodying the principles and concepts of the present invention and generally designated by the reference numeral 10 will be described.

Specifically, it will be noted with reference to FIGS. 1 through 6 that the present invention is a new and improved dickie 10 of a cylindrical knit. The dickie includes a pocket 12 for a warmer pack 14.

More specifically, the dickie comprises a tubular upper extent 18 formed with a neck opening 20, also of a tubular configuration. The upper extent is a reduced diameter. The neck opening 20 has a turned over upper end 22 and a pair of knitted layers 24 and 26 with downwardly extending lower ends 28 and 30. The dickie 10 has an intermediate extent 34 formed in the shape of a cone having a reduced diameter at its upper end 36. The upper ends of the two layers 38 and 40 of the intermediate extent are formed as integral extensions of the lower ends of the upper extent. The intermediate extent has an enlarged diameter at its lower ends a reduced diameter at its upper ends and with an increasing diameter from the upper diameter to the lower diameter. The intermediate extent 34 is formed as a pair of knitted layers 38 and 40.

A lower extent 44 is formed as a body opening of a cylindrical configuration having an enlarged diameter. The body opening has a pair of knitted layers 46 and 48 with downwardly extending lower ends 50.

A pair of diametrically opposed vertical slits 54 extend upwardly from the lower ends 50 of the lower extent 44 to adjacent the lower end of the intermediate extent 34. The slits 54 allow for donning the dickie 10 over a wearer's shoulders.

A pocket 12 is formed at a cut 56 at the upper extent 18. The pocket extends horizontally and is for the removable receipt of a warmer pack 14. The pocket 12 is located circumferentially centered midway between the vertical slits 54 to position the pocket 12 and its supported warmer pack 14 over the chest of a wearer.

The present invention is a dickie with a pocket installed in the rear side of the collar area to be used for a disposable hand warmer pack. It applies mild heat to a specific area of the body which helps ward of chills which are often resulting from extended periods of inactivity while out in the cold weather.

The present invention is rib-knitted on Tomkins machine with a seven inch round cylinder having 146 needles. It is knitted in the shape of a tube pulled inside itself making it a double thickness. The pocket slot is cut and the pocket sewn in. The sides are cut and sewn to separate front and rear flaps. The collar can be rolled down.

It is of particular benefit to hunters, ice fishermen, construction workers, cold-climate outdoor sports observers and the like.

The present invention is lightweight and folds readily into the pocket of a user. It can be easily put on or taken off without removing the outer garment as may be needed by the wearer. The heater can be added or removed without removing the dickie. It can be made of any type of yarn, preferably acrylic, as some people find wool against the skin to be uncomfortable.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved dickie of a cylindrical knit with a pocket for a warmer pack comprising, in combination:

an upper extent formed with a neck opening of a cylindrical configuration for passage of a wearer's head and having a reduced diameter, the neck opening having a turned over upper end and a pair of knitted layers with downwardly extending lower ends;

an intermediate extent formed in the shape of a cone having a reduced upper diameter formed as integral extensions of the lower portion of the upper extent and having an enlarged lower diameter with an increasing diameter from the upper diameter to the lower diameter, the intermediate extent being formed as a pair of knitted layers;

a lower extent formed as a body opening and having a cylindrical configuration with an enlarged diameter, the body opening including a pair of knitted layers with downwardly extending lower ends and with upper ends formed as integral extensions of the lower ends of the intermediate extent;

a pair of diametrically opposed vertical slits for passage of a wearer's shoulders extending upwardly from the lower ends of the lower extent to adjacent the lower ends of the intermediate extent; and a pocket formed at a horizontal cut in the upper extent for the removable receipt of a warmer pack, the pocket located circumferentially centered midway between the vertical slits.

2. A dickie of a generally cylindrical configuration comprising:

an upper extent formed with a neck opening of a cylindrical configuration for passage of a wearer's head and having a reduced diameter, the neck opening having a turned over upper end and a pair of knitted layers with downwardly extending lower ends;

an intermediate extent formed in the shape of a cone having a reduced upper diameter formed as integral extensions of the lower portion of the upper extent and having an enlarged lower diameter with an increasing diameter from the upper diameter to the lower diameter, the intermediate extent being formed as a pair of knitted layers; and a lower extent formed as a body opening and having a cylindrical configuration with an enlarged diameter, the body opening including a pair of knitted layers with downwardly extending lower ends and with upper ends formed as integral extensions of the lower ends of the intermediate extent.

3. The dickie as set forth in claim 2 and further including:

a pair of diametrically opposed vertical slits for passage of a wearer's shoulders extending upwardly from the lower ends of the lower extent to adjacent the lower ends of the intermediate extent.

4. The dickie as set forth in claim 2 and further including:

a pocket formed at a horizontal cut in the upper extent for the removable receipt of a warmer pack, the pocket located circumferentially centered midway between the vertical slits.

* * * * *